US011688956B2

(12) United States Patent
Froebing

(10) Patent No.: US 11,688,956 B2
(45) Date of Patent: Jun. 27, 2023

(54) CONTACT INSERT FOR A CONDUCTOR CONNECTION TERMINAL, AND CONDUCTOR CONNECTION TERMINAL PRODUCED THEREWITH

(71) Applicant: WAGO Verwaltungsgesellschaft mbH, Minden (DE)

(72) Inventor: Jens Froebing, Gotha (DE)

(73) Assignee: WAGO Verwaltunosgesellschaft mbH, Minden (DE)

( * ) Notice: Subject to any disclaimer, the term of this patent is extended or adjusted under 35 U.S.C. 154(b) by 267 days.

(21) Appl. No.: 17/219,332

(22) Filed: Mar. 31, 2021

(65) Prior Publication Data

US 2021/0218161 A1 Jul. 15, 2021

Related U.S. Application Data

(63) Continuation of application No. PCT/EP2019/076741, filed on Oct. 2, 2019.

(30) Foreign Application Priority Data

Oct. 5, 2018 (DE) ..... 10 2018 124 623.4

(51) Int. Cl.
*H01R 13/187* (2006.01)
*H01R 4/48* (2006.01)
(Continued)

(52) U.S. Cl.
CPC ..... *H01R 4/4836* (2013.01); *H01R 11/11* (2013.01); *H01R 43/20* (2013.01)

(58) Field of Classification Search
CPC ..... H01R 13/62933; H01R 4/4845; H01R 4/4836
See application file for complete search history.

(56) References Cited

U.S. PATENT DOCUMENTS 4,978,315 A * 12/1990 Edgley ..... H01R 4/4827 439/441
5,685,735 A * 11/1997 Hohorst ..... H01R 4/4836 439/441
(Continued)

FOREIGN PATENT DOCUMENTS

DE 102008060283 A1 7/2010
DE 102010025930 A1 1/2012
(Continued)

OTHER PUBLICATIONS

International Search Report dated Dec. 20, 2019 in corresponding application PCT/EP2019/076741.

*Primary Examiner* — Neil Abrams
(74) *Attorney, Agent, or Firm* — Muncy, Geissler, Olds & Lowe , P.C.

(57) ABSTRACT

A contact insert for a conductor connection terminal, including spring force clamping technology, wherein the contact insert has a clamping spring and a manual actuation element, wherein the clamping spring has a clamping arm which is designed to clamp an electrical conductor to a clamping point, wherein the clamping point can be opened by means of the manual actuation element. The invention additionally relates to a conductor connection terminal comprising an insulating-material housing and at least one such contact insert which is arranged completely or partially in the insulating-material housing.

18 Claims, 6 Drawing Sheets

(51) Int. Cl.
*H01R 11/11* (2006.01)
*H01R 43/20* (2006.01)

(56) References Cited

U.S. PATENT DOCUMENTS

| | | | | | |
|---|---|---|---|---|---|
| 5,915,991 | A * | 6/1999 | Roman | H01R 4/4827 | 439/441 |
| 6,146,187 | A * | 11/2000 | Pallai | H01R 4/4836 | 439/441 |
| 7,004,781 | B2 * | 2/2006 | Walter | H01R 4/4836 | 439/441 |
| 7,988,504 | B2 * | 8/2011 | Stromiedel | H01R 4/4818 | 439/809 |
| 9,413,082 | B2 | 8/2016 | Gassauer | | |
| 9,478,874 | B2 * | 10/2016 | Stolze | H01R 4/4845 | |
| 9,525,219 | B2 * | 12/2016 | Köllmann | H01R 4/4845 | |
| 10,594,053 | B2 * | 3/2020 | Koellmann | H01R 9/2408 | |
| 11,146,018 | B2 * | 10/2021 | Koellmann | H01R 13/62961 | |
| 11,289,845 | B2 * | 3/2022 | Geske | H01R 13/514 | |
| 11,476,610 | B2 * | 10/2022 | Ahldag | H01R 13/187 | |
| 2019/0245281 | A1 | 8/2019 | Sonderer et al. | | |

FOREIGN PATENT DOCUMENTS

| | | | |
|---|---|---|---|
| DE | 102013101411 | A1 | 8/2014 |
| DE | 102014119416 | A1 | 6/2016 |
| DE | 202015105993 | U1 | 2/2017 |
| DE | 102016116966 | A1 | 3/2018 |
| DE | 202017100038 | U1 | 4/2018 |
| EP | 2917971 | B1 | 12/2016 |
| WO | WO2018036886 | A1 | 3/2018 |

* cited by examiner

CONTACT INSERT FOR A CONDUCTOR CONNECTION TERMINAL, AND CONDUCTOR CONNECTION TERMINAL PRODUCED THEREWITH

This nonprovisional application is a continuation of International Application No. PCT/EP2019/076741, which was filed on Oct. 2, 2019 and which claims priority to German Patent Application No. 10 2018 124 623.4, which was filed in Germany on Oct. 5, 2018 and which are both herein incorporated by reference.

BACKGROUND OF THE INVENTION

Field of the Invention

The present invention relates to a contact insert for a conductor connection terminal, comprising spring force clamping technology, wherein the contact insert has a clamping spring and a manual actuation element, wherein the clamping spring has a clamping arm which is designed to clamp an electrical conductor to a clamping point, wherein the clamping point can be opened by means of the manual actuation element. The invention additionally relates to a conductor connection terminal comprising an insulating-material housing and at least one such contact insert which is arranged completely or partially in the insulating-material housing.

Description of the Background Art

In general, the invention relates to the field of spring force clamping technology for electrically contacting electrical conductors. There are already a large number of proposals for realizing such conductor connection terminals and their contact inserts, e.g., in EP 2 917 971 B1, which corresponds to US 2015/0357727, which is incorporated herein by reference. The components involved in the connection of the electrical conductor, i.e., for its clamping and electrical contacting, are referred to as a contact insert. A complete conductor connection terminal has at least one such contact insert and an insulating-material housing completely or partially surrounding the contact insert. The manual actuation of the clamping arm to open the clamping point can take place, depending on the type of execution, e.g., using an external tool that is not part of the contact insert or the conductor connection terminal. The present invention relates to the field of contact inserts and conductor connection terminals with their own manual actuation element; i.e., the manual actuation element is part of the contact insert or conductor connection terminal. The actuation element can be, for example, a pusher, e.g., a linearly displaceable pusher, or a pivotable lever.

SUMMARY OF THE INVENTION

It is therefore an object of the present invention to provide a compact and universally usable contact insert for a conductor connection terminal. In addition, a conductor connection terminal with such a contact insert is to be provided.

This object is achieved with a contact insert that includes: the contact insert has one or more metal parts; the clamping spring is formed in one piece on a metal part; a engagement arm, which is opposite the clamping arm, is formed in one piece on a metal part, so that the clamping point for the electrical conductor can be arranged between the clamping arm and the engagement arm; and the actuation element is movably mounted between the clamping arm and the engagement arm.

The contact insert has the advantage that it can be provided in a simple manner in terms of production technology and accordingly cost-effectively. This is achieved, in one respect, in that the contact insert has one or more metal parts on which the clamping spring and the engagement arm are already integrally formed. Only the actuation element is required as a further component, so that the contact insert of the invention can be provided with two or at least a few separate components, namely metal part(s) and an actuation element. Such a metal part can be designed as a sheet metal part or some other sheet-like component, e.g., provided as a stamped/bent component, e.g., by being stamped out of a flat metal sheet and bent repeatedly. It is advantageous if, for example, only one integrally formed metal part is used, on which both the clamping spring and the engagement arm are integrally formed, or if two metal parts are used and the clamping spring is integrally formed on one metal part and the engagement arm is integrally formed on the other metal part. These two metal parts can be, e.g., detachably or permanently connected to one another, e.g., by screwing, riveting, gluing, soldering, or welding.

The actuation element is advantageously mounted on the metal part, specifically between the clamping arm and the engagement arm. This is beneficial for a compact design of the contact insert as well as for the universal applicability in conductor connection terminals of various types. In this way, the actuation element can be in contact both directly with the clamping arm and directly with the engagement arm. The actuation element movably mounted between the clamping arm and the engagement arm can be clamped, e.g., between the clamping arm and the engagement arm, i.e., held under a pretension between the clamping arm and the engagement arm. The actuation element can also be received completely or almost without tension between the clamping arm and the engagement arm. The actuation element is, in one respect, fixed in its basic position via its fastening by being clamped between the clamping arm and the engagement arm, but is still movable so that the required actuation movement for opening the clamping point can be carried out.

The bearing point of the actuation element can be arranged permanently between the clamping arm and the engagement arm, regardless of the actuation state of the actuation element.

In this way, the contact insert can be provided as a self-supporting contact insert. This means that the assembly, comprising the metal part or metal parts and the actuation element clamped there, can be provided as an independently manageable assembly in which the actuation element does not become readily detached again from the metal part or metal parts. The assembly, i.e., the contact insert, is particularly suitable for bulk goods and for automatic assembly.

The manual actuation element can in particular be moved manually back and forth between an open position and a closed position. The open position of the actuation element corresponds to an open clamping point, in which an electrical conductor can be inserted without effort or can be removed from the clamping point. The closed position of the actuation element corresponds to a closed clamping point, i.e., a state in which an electrical conductor is clamped to the clamping point by the clamping arm or, if no electrical conductor is inserted, the clamping arm rests against the engagement arm or a busbar.

The metal part can have at least one connecting section by which the engagement arm is connected directly or indirectly to the clamping arm. Thus, the engagement arm, e.g., can be connected to the clamping arm indirectly via at least one further section connected to the clamping arm. Accordingly, the engagement arm is not directly connected to the clamping arm; at least the connecting section represents an additional part of the integrally formed metal part or the multiple metal parts via which the engagement arm is connected to the clamping arm. For example, in addition to the clamping arm, the clamping spring can also have a spring bend, which adjoins the clamping arm, and a contact arm, which adjoins the spring bend. The contact arm can then be connected to the engagement arm via the connecting section.

The connecting section can form a guide surface for the electrical conductor to be clamped. In this way, the guiding of the electrical conductor can be improved without additional components.

The contact insert can have a conductor insertion direction in which the electrical conductor to be clamped is to be inserted into the contact insert, wherein the connecting section is arranged substantially parallel to the conductor insertion direction of the contact insert. In this way, the connecting section can run alongside the inserted electrical conductor, so to speak, so that the electrical conductor can be guided laterally past the connecting section to the clamping point. This is also beneficial for a compact design of the contact insert and a conductor connection terminal formed therewith.

The actuation element can have at least one bearing pin which rests against the engagement arm. Thus, the actuation element is supported thereon via the bearing pin in the direction of the engagement arm. In the case of a pivotable actuation element, the bearing pin can be designed as a bearing axis; i.e., the bearing axis can simultaneously form the axis of rotation of the actuation element during pivoting.

The engagement arm can have a bulge at or near its free end, which is opposite the clamping arm, a bulge which forms a receptacle for the bearing pin of the actuation element. The bulge can be designed, e.g., in the form of an engagement arm curvature that describes a segment of a circle. This allows the actuation element to be securely fixed at the desired location on the metal part. The bearing pin can be designed as a cylindrical bearing pin. The bulge of the engagement arm can be open in a direction pointing towards the clamping arm.

The engagement arm can extend beyond the bulge with an end section up to its free end, wherein the end section forms an insertion aid for the bearing pin during the mounting of the actuation element on the metal part. In this way, the assembly of the components mentioned, namely the actuation element and the metal part, is furthered and simplified. In particular, automatic assembly is possible with little effort.

The actuation element can have a manual actuation area at which the actuation element is to be acted upon manually in order to open the clamping point, wherein two spaced apart side cheeks of the actuation element protrude from the manual actuation area, and that the engagement arm is arranged between the side cheeks. Thus, e.g., the side cheeks can adjoin the engagement arm and/or surround the engagement arm. Accordingly, the actuation element can be arranged at least partially overlapping with the metal part; this in turn is beneficial for the compact design of the contact insert and the conductor connection terminal.

The actuation element can be realized in this way with an inner open area between the side cheeks. This space between the side cheeks can be used for placing additional elements, as will be explained below. This is also beneficial for a compact design of the contact insert and the conductor connection terminal.

On the outside of one or both side cheeks, i.e., in the area beyond the area enclosed by the side cheeks, the actuation element can have a stub axle protruding from a side cheek. The stub axle can be arranged concentrically to the bearing pin, so that it forms an extension of the bearing pin towards the outside; the stub axle can also be arranged offset to the bearing pin. An additional fixation of the contact insert in an insulating-material housing of the conductor connection terminal and at the same time an additional rotary bearing for the actuation element can be realized by the stub axle or stub axles.

The bearing pin can extend from one side cheek to the other side cheek. This allows compact attachment of the actuation element to the metal part.

The contact insert can have a conductor insertion area into which the electrical conductor to be clamped is to be inserted, wherein the conductor insertion area extends through the area enclosed by the side cheeks. Accordingly, the electrical conductor can be accommodated in an installation space enclosed by the side walls.

The clamping arm can have a clamping tongue on which a clamping edge for clamping the electrical conductor is arranged, wherein the clamping arm has at least one or two actuating tabs which are arranged laterally next to the clamping tongue, wherein the at least one or two actuating tabs each form contact surfaces for mechanical action by the actuation element to open the clamping point. In this way, the clamping tongue can be shaped and dimensioned exclusively for its function of clamping the electrical conductor. For the function of actuating the clamping arm, the at least one or two actuating tabs are used, which in turn can be shaped and dimensioned separately for their function for mechanical actuation.

According to an example of the invention, it is provided that the at least one or two actuating tabs simultaneously form a counter bearing with respect to the mounting of the actuation element on the engagement arm. This has the advantage that no further elements are required for the counter bearing of the actuation element. Instead, in addition to their function as actuation elements of the clamping arm, the one or two actuating tabs can also take on the counter bearing function.

The at least one or two actuating tabs can be bent in the same direction as the bulge. If the metal part is viewed, for example, in a plan view of the engagement arm, then the one or two actuating tabs and the bulge can each be formed convexly curved.

The actuation element can have a mounting recess on one or both side cheeks, wherein the actuation element in the closed position is positively mounted on a respective actuating tab via a respective mounting recess, wherein the shape of the mounting recess is adapted to the shape of the respective actuating tab. This allows a secure mounting and fixing of the actuation element on the metal part, so that the actuation element is also reliably fixed in the direction of the clamping arm by the positive connection.

The actuation element can have an actuation contour on one or both side cheeks for actuating an associated actuating tab and accordingly for deflecting the clamping arm, wherein the actuation contour comes into contact with the associated actuating tab when the actuation element is in the open position or is moved from the closed position into the open position. This allows reliable mechanical actuation of the clamping arm.

The bulge in the engagement arm and the actuating tabs can be at least approximately opposite one another, so that the actuation element can be received and clamped therebetween in a positive and nonpositive manner. This enables the provision of a preassemblable modular contact insert suitable for bulk goods.

The contact insert can have a busbar as a further component, which extends between the engagement arm and the clamping arm, wherein the busbar rests with a bearing side against the engagement arm and with a contact side, opposite the bearing side, together with the clamping arm forms the clamping point for the electrical conductor. The electrical contacting of the electrical conductor is further improved by such a busbar. In addition, the busbar can be used as an electrical contact element for contacting further elements of the conductor connection terminal, e.g., as an electrical bridge to a further assembly or for bridging between multiple adjacently arranged contact inserts of a multiple conductor connection terminal.

The busbar can be an optional component of the contact insert; i.e., the contact insert can also be used without the busbar.

The aforementioned object is additionally achieved by a conductor connection terminal comprising an insulating-material housing and at least one contact insert of the type explained above, which is arranged completely or partially in the insulating-material housing. The previously described advantages can also be realized hereby.

The busbar can be inserted into the contact insert through a cutout present in the insulating-material housing, e.g., when the actuation element is open. This allows a subsequent assembly of the busbar on the contact insert if this is already installed in the insulating-material housing.

Within the context of the present invention, the indefinite article "a" ("an") is not to be understood as a numeral. If therefore, e.g., a component is being discussed, this should be interpreted in the sense of "at least one component." Insofar as angles are given in degrees, they refer to a circular measure of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

In the explained exemplary embodiments, the actuation element is shown by way of example as a pivotable actuation lever. The explanations also apply analogously to the embodiment of the actuation element as a pusher.

Figure 1:
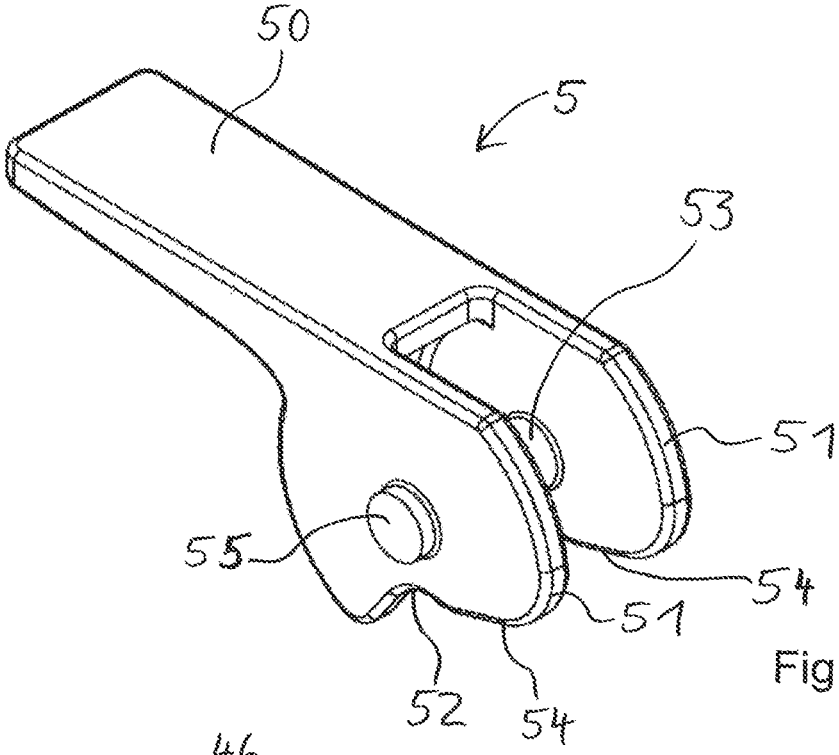
FIG. 1 shows an actuation element in a perspective illustration.

Actuation element 5 shown in FIG. 1 has a manual actuation area 50, e.g., in the form of a lever arm. The manual actuation area is used to manually act on the actuation element in order to pivot it. Two spaced apart side cheeks 51 protrude from manual actuation area 50. A bearing pin 53 extends between side cheeks 51. A stub axle 55 is arranged on one or both side cheeks 51 on the outside in each case, i.e., on the side of the respective side cheek 51, said side facing away from bearing pin 53. Bearing pin 53 and stub axle 55 are arranged coaxially to one another. Side cheeks 51 each have, on a side directed towards the clamping arm, a substantially concave mounting recess 52 and an actuation contour 54 formed eccentrically with respect to bearing pin 53. A clamping arm can be deflected with actuation contour 54, as will still be described below.

If actuation element 5 were to be designed as a pusher, it could be designed in a comparable manner with regard to side cheeks 51, bearing pin 53, mounting recess 52, and stub axle 55. A manual actuation area 50 would then be located, for example, in the form of a pusher surface above side cheeks 51 or also on the side facing conductor insertion direction L.

Figure 2:
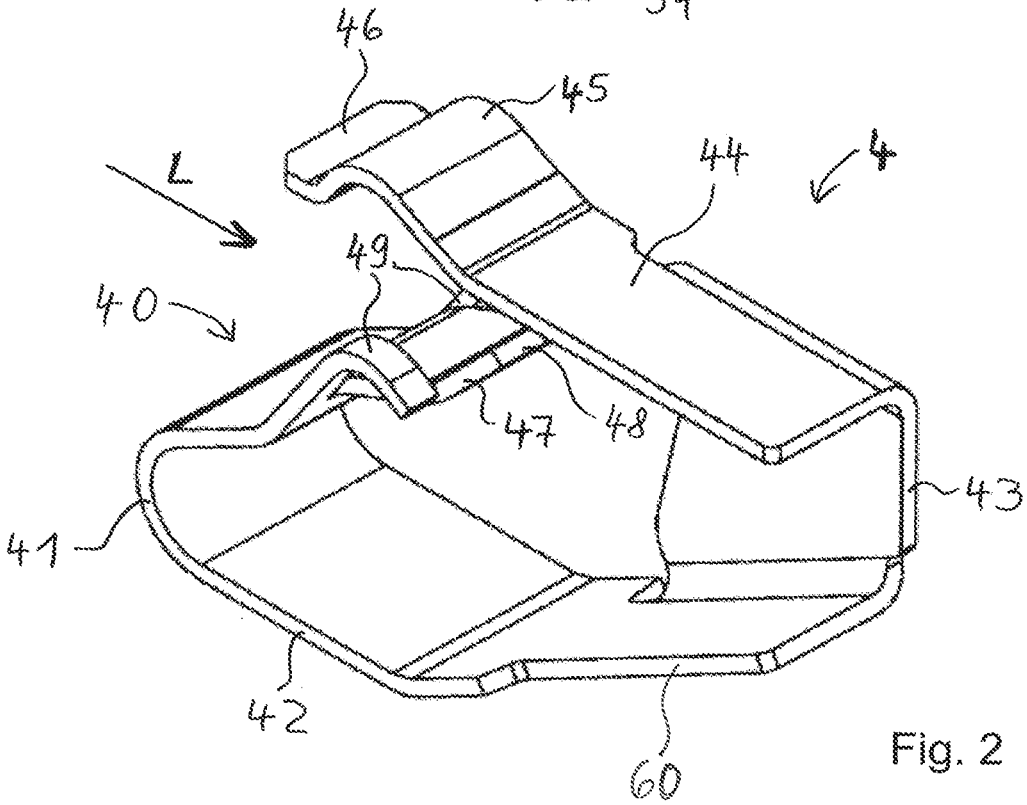
FIG. 2 shows a metal part formed as one piece in a perspective illustration.

FIG. 2 shows an integrally formed metal part 4 on which a clamping spring 40, 41, 42, an engagement arm 44, and a connecting section 43, connecting engagement arm 44 to clamping spring 40, 41, 42, is formed in one piece. Clamping spring 40, 41, 42 has a clamping arm 40, a spring bend 41, adjoining the clamping arm, and a contact arm 42, which adjoins spring bend 41 and extends over an angled area up to connecting section 43. Clamping arm 40 at the end divides into a clamping tongue 47 and two actuating tabs 49 located laterally from clamping tongue 47. Clamping tongue 47 ends with a clamping edge 48 which comes into contact with an electrical conductor when the latter is clamped to a clamping point of the contact insert. The clamping point can be formed, for example, between clamping edge 48 and a surface of engagement arm 44, said surface facing clamping edge 48. The area of metal part 4 denoted by reference numeral 60 can optionally be included with contact arm 42 or connecting section 43.

Clamping tongue 47 can be bent, for example, in the opposite direction of curvature to actuating tabs 49. Actuating tabs 49 can laterally overlap, for example, clamping tongue 47 and can be moved forward, for example, in the direction of engagement arm 44.

Engagement arm 44 extends beyond a bulge 45 to an end section 46. Bulge 45 serves to receive and support bearing pin 53 of actuation element 5.

Figure 3:
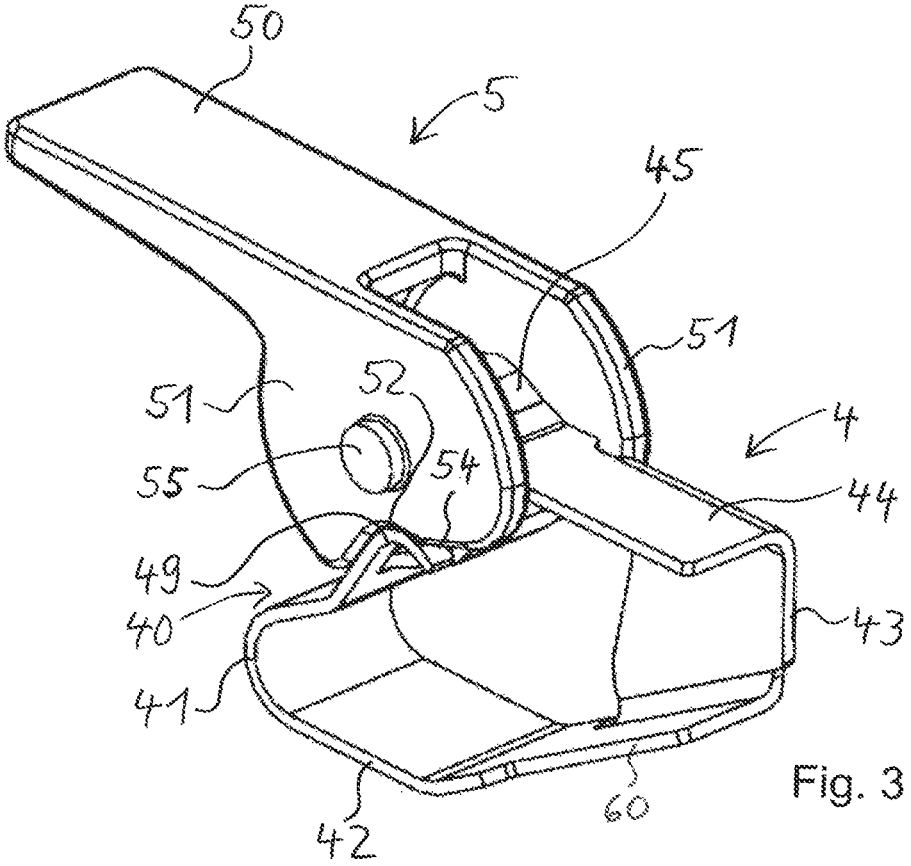
FIG. 3 shows a contact insert in a perspective illustration.
Figure 4:
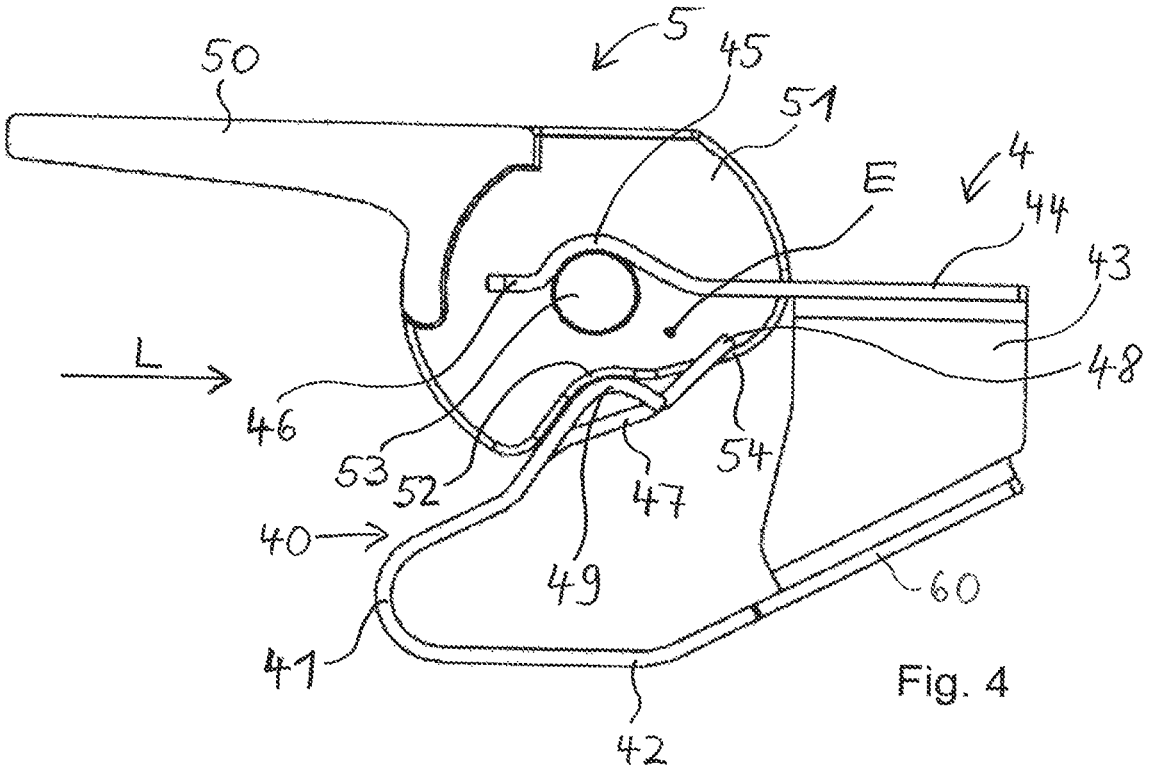
FIG. 4 shows the contact insert according to FIG. 3 in a partially cutaway side view.

Whereas FIGS. 1 and 2 each show the components of the contact insert, i.e., actuation element 5 and metal part 4, separately, FIG. 3 shows these components in the state assembled to form the contact insert. FIG. 4 shows the contact insert according to FIG. 3 in a side view, wherein actuation element 5 is shown cut away in the middle in the longitudinal direction, so that the elements located behind upper side cheek 51 can be seen.

As can be seen, actuation element 5 is now clamped between clamping arm 40 and engagement arm 44. Here, bearing pin 53 comes to rest on the inside of bulge 45. Actuating tabs 49, which come into contact with mounting recesses 52 on side cheeks 51 of actuation element 5, are used as counter bearings. Actuation element 5 is securely fixed in metal part 4 in this way but can nevertheless execute a pivoting movement about bearing pin 53.

It can be seen further that an electrical conductor, which is inserted into the contact insert to the clamping point in the conductor insertion direction L, is to be inserted into a conductor insertion area E which is located at least partially between side cheeks 51. In this way, the electrical conductor can be pushed through between side cheeks 51, which also form a guide for the electrical conductor, and uses the installation space located therebetween. The conductor insertion area E can extend relatively far backwards in the conductor insertion direction, because it is not limited by connecting section 43 in the conductor insertion direction. This is due to the fact that connecting section 43 laterally establishes the connection between engagement arm 44 and the clamping spring.

Figure 5:
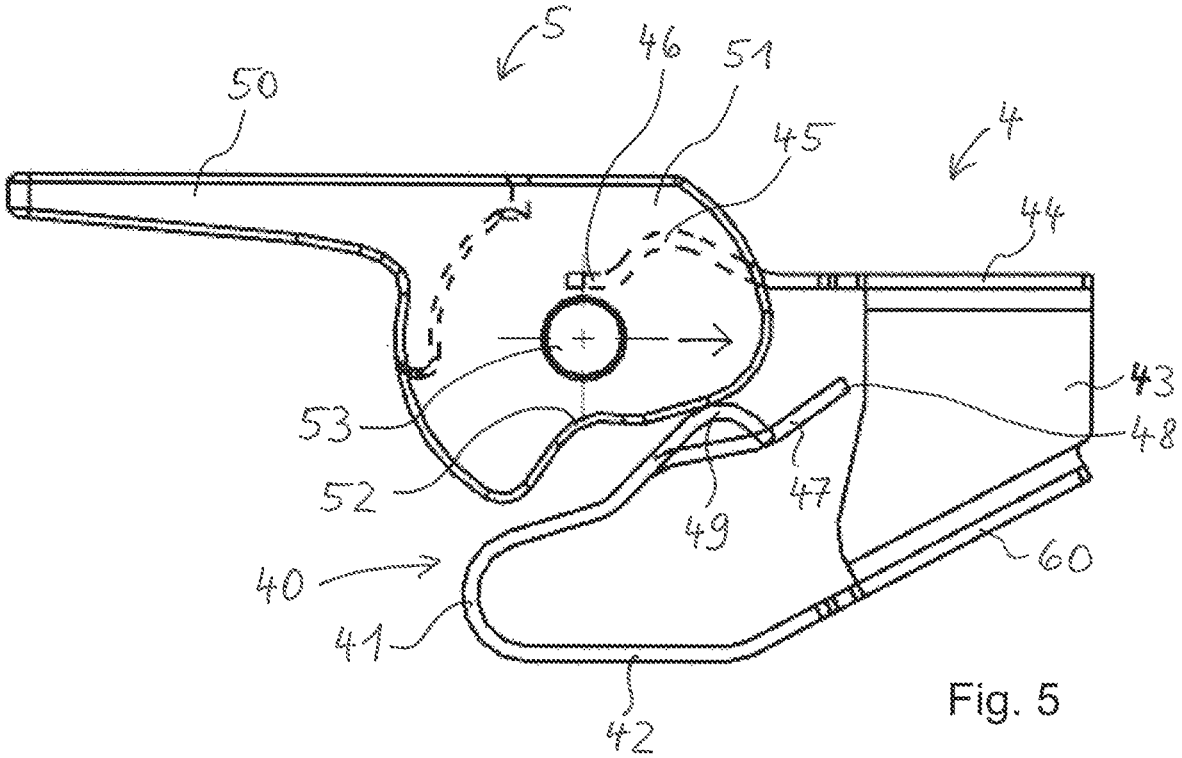
FIG. 5 shows a step of mounting the actuation element on the metal part in a side view.
Figure 6:
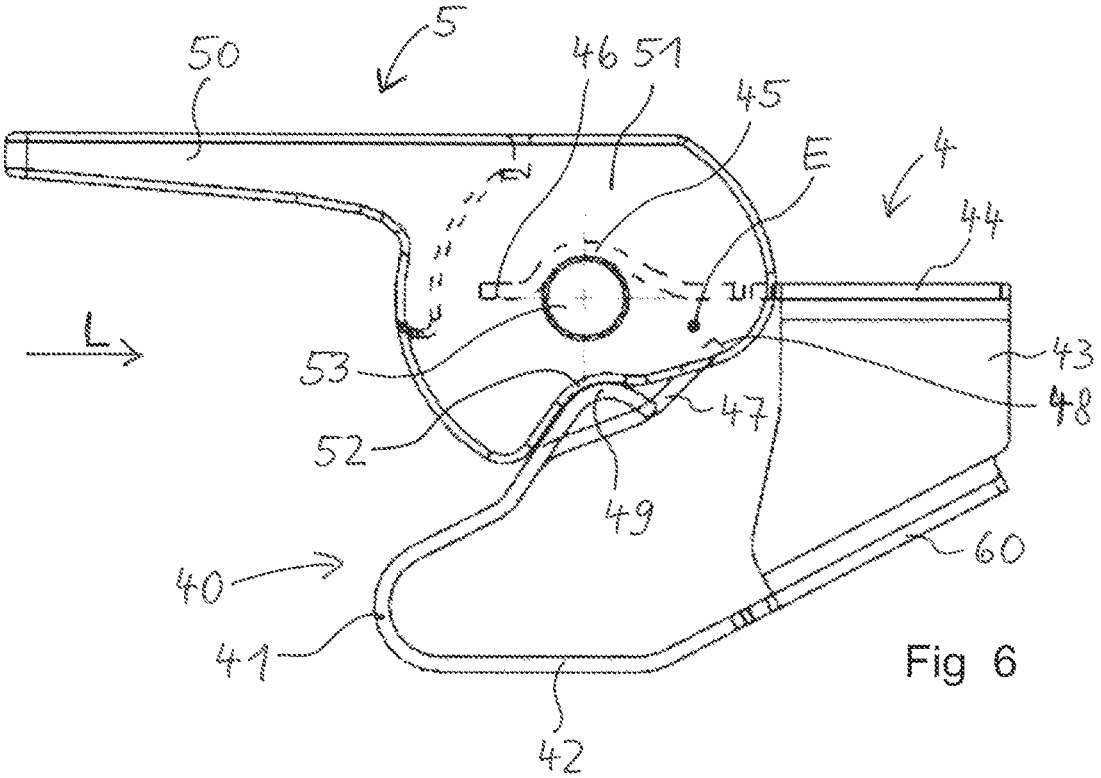
FIG. 6 shows the contact insert according to FIG. 4 in a non-cutaway side view.

FIG. 5 shows the procedure during the insertion of actuation element 5 into metal part 4. If actuation element 5 is inserted in the shown direction of the arrow, actuation element 5 pushes the springy areas of metal part 4 slightly apart due to the contact of bearing pin 53 with end section 46, which serves as an insertion aid, and the contact between actuation contour 54 and actuating tabs 49. In particular, clamping arm 40 is deflected downwards hereby. Finally, actuation element 5 arrives at the desired position at which bearing pin 53 lies in bulge 45 and mounting recess 52 engages over actuating tab 49 in a positive manner, as FIG. 6 shows.

Figure 7:
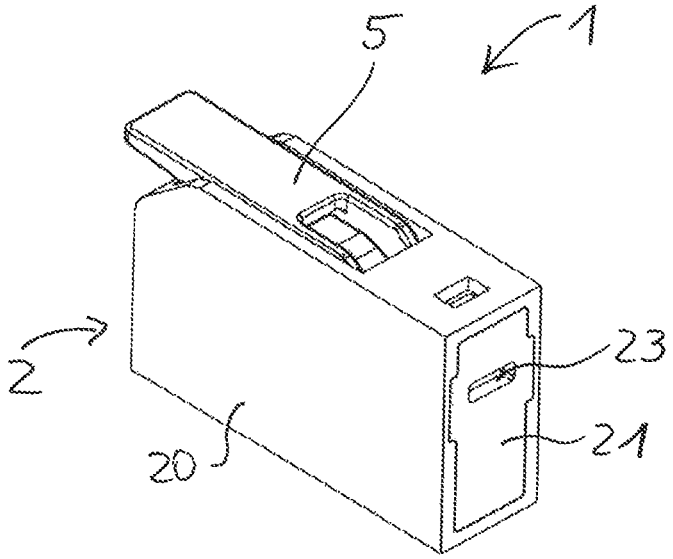
FIG. 7 shows a conductor connection terminal in a perspective view.

FIG. 7 shows a conductor connection terminal 1 in which a contact insert of the type explained above is arranged in an insulating-material housing 2. Because insulating-material housing 2 largely surrounds the parts of the contact insert, only manual actuation area 50 of actuation element 5 and parts of side cheeks 51 are visible, for example.

The insulating-material housing can be constructed, for example, in a number of parts, e.g., with a main housing part 20 and a cover part 21. Cover part 21 is mounted on main housing part 20 after the contact insert has been mounted in main housing part 20, e.g., by being snapped into place there.

Figure 8:
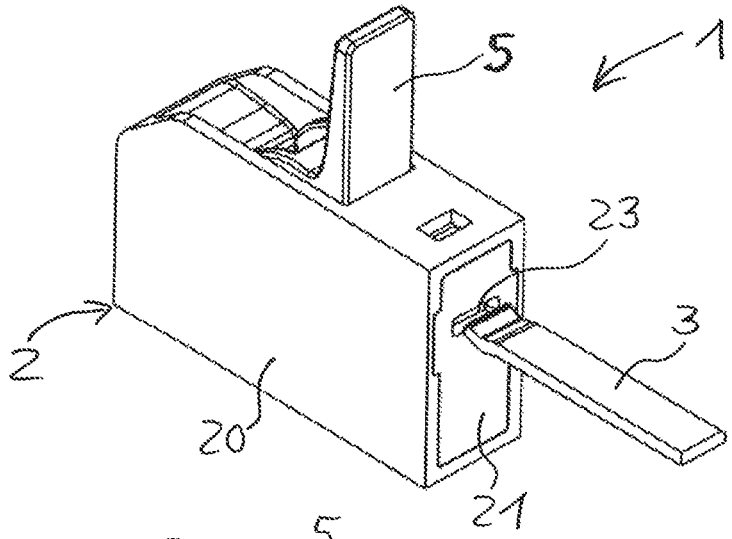
FIG. 8 shows a step of mounting a busbar in a conductor connection terminal according to FIG. 7 in a perspective view.
Figure 9:
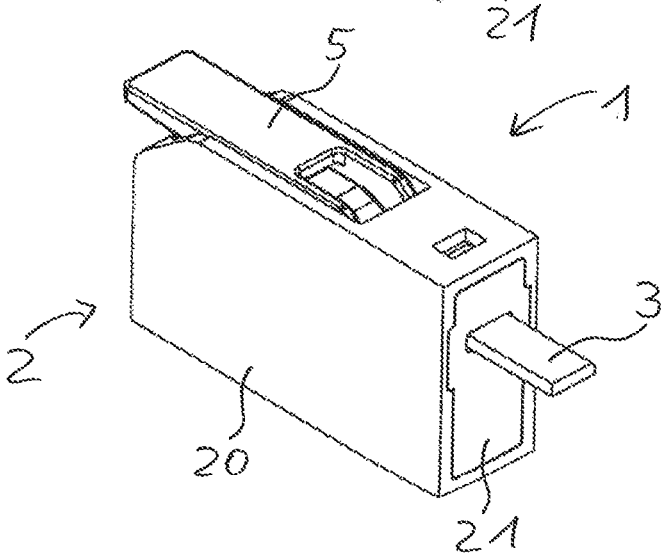
FIG. 9 shows the conductor connection terminal with a mounted busbar in a perspective illustration.

As FIG. 7 already shows, cover part 21 can have a cutout 23. Cutout 23 can be used to pass a busbar 3 through cover part 21. FIG. 8 shows that busbar 3 can be subsequently inserted into the already assembled conductor connection terminal 1, as shown in FIG. 7. For this purpose, actuation element 5 is pivoted into the open position in which the manual actuation area projects, for example, vertically upwards from insulating-material housing 2. If busbar 3 has been placed in the desired position, manual actuation element 5 can be moved back into the closed position, as FIG. 9 shows. Busbar 3 can protrude from insulating-material housing 2 in order to provide an electrical contacting option for further electrical elements.

Figure 10:
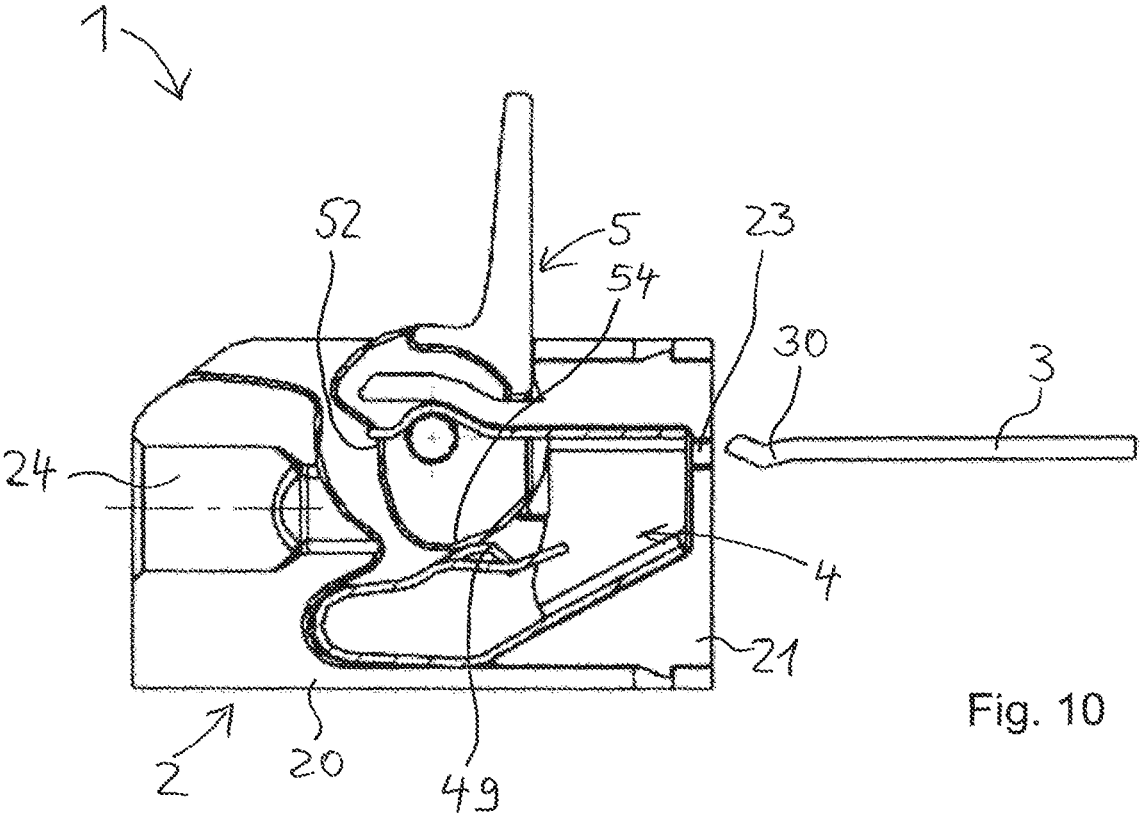
FIG. 10 shows the step of mounting the busbar in the conductor connection terminal according to FIG. 8 in a partially cutaway side view.

FIG. 10 shows the step of mounting busbar 3 in conductor connection terminal 1 in a side view, wherein parts of the conductor connection terminal are again shown cut away. Busbar 3 can also have a protrusion 30 which projects from the rest of the surface of busbar 3 in the direction of clamping arm 40. In this way, the clamping of an electrical conductor can be further improved in mechanical and electrical terms.

It can be seen that insulating-material housing 2 can have a conductor insertion opening 24 in addition to the elements already explained. The electrical conductor can be inserted through conductor insertion opening 24 in the conductor insertion direction L into insulating-material housing 2 at least up to the clamping point.

It can also be seen in FIG. 10 that actuation element 5 in the open position deflects clamping arm 40 downwards via actuation contour 54 and accordingly opens the clamping point. This takes place in that actuating tabs 49 are acted upon mechanically via actuation contour 54. In this state, mounting recess 52 is not in contact with the clamping spring.

Figure 11:
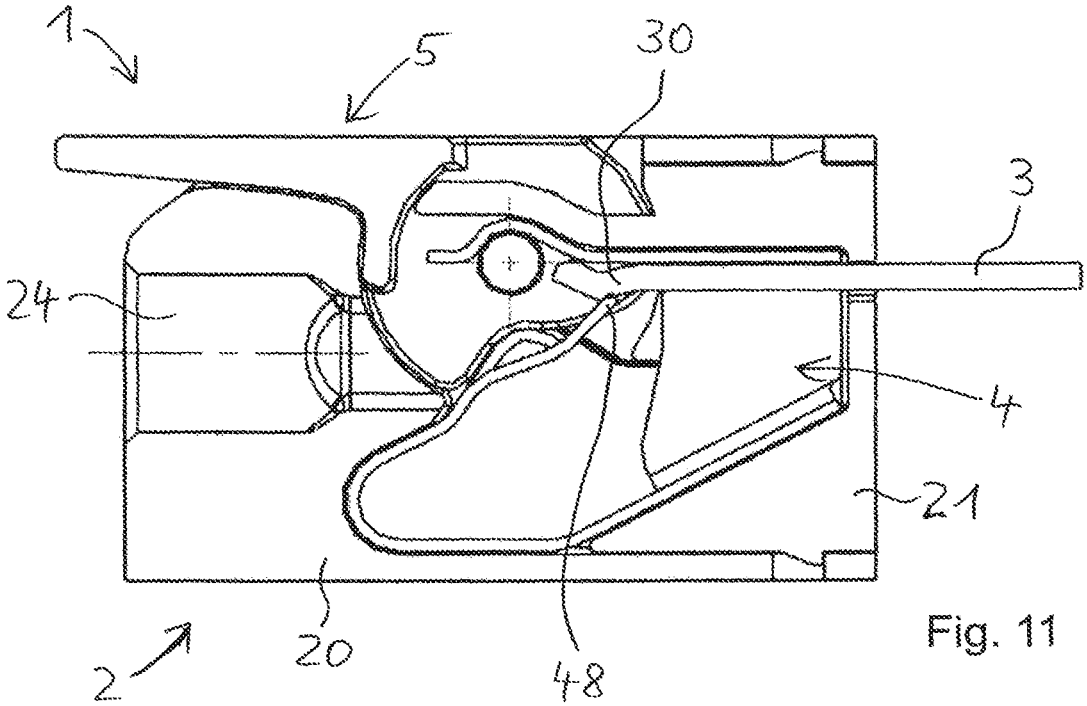
FIG. 11 shows the conductor connection terminal according to FIG. 9 in a partially cutaway side view.

FIG. 11 shows conductor connection terminal 1 according to FIG. 10 when actuation element 5 is again in the closed position. It can be seen that the clamping tongue with clamping edge 48 now comes to rest against protrusion 30 of the busbar.

Figure 12:
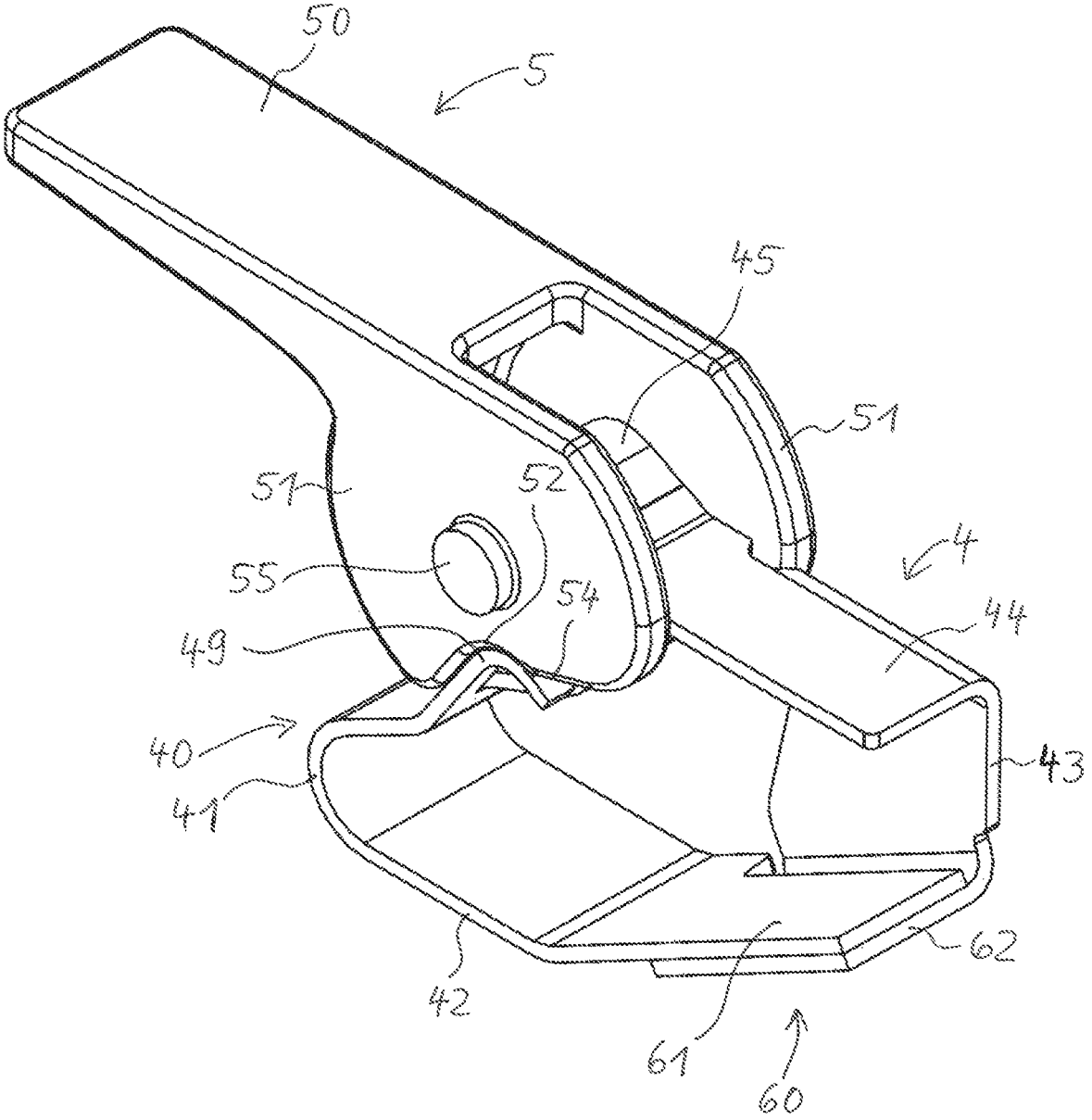
FIG. 12 shows a further embodiment of a contact insert in a perspective illustration.

FIG. 12 shows a further embodiment of a contact insert which, apart from the differences described below, corresponds to the embodiment described above. FIG. 12 in this case shows a view comparable to FIG. 3.

In contrast to the embodiment described above, there is no integrally formed metal part 4 in FIG. 12. Instead, metal part 4 is designed in the form of two individual metal parts which are connected to one another in area 60. For this purpose, the metal part having clamping spring 40, 41, 42 has a securing tab 61. The metal part having engagement arm 44 has a securing tab 62. Securing tabs 61, 62 overlap one another. The two individual metal parts are connected to form a single structural unit via this overlap area of securing tabs 61, 62, e.g., by a detachable or nondetachable connection.

The embodiment shown in FIG. 12 with multiple metal parts connected to one another can also be designed differently. Thus, e.g., the described overlap between securing tabs 61, 62 can also be realized in the area of contact arm 42, connecting section 43, or engagement arm 44. There can also be a number of such overlapping points, so that the metal part assembled as a result can consist of more than two individual metal parts.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A contact insert for a conductor connection terminal comprising spring force clamping technology, the contact insert comprising:

a clamping spring; and a manual actuation element, wherein the clamping spring has a clamping arm which is designed to clamp an electrical conductor to a clamping point, wherein the clamping point is adapted to be opened by the manual actuation element, wherein the contact insert has at least one metal part, wherein the clamping spring is formed in one piece on the at least one metal part, wherein the at least one metal part has an engagement arm which is arranged opposite the clamping arm, so that the clamping point for the electrical conductor is arranged between the clamping arm and the engagement arm, wherein the actuation element is movably mounted between the clamping arm and the engagement arm, and wherein the actuation element has a bearing pin which rests against the engagement arm.

2. The contact insert according to claim 1, wherein the contact insert is designed as a self-supporting contact insert.

3. The contact insert claim 1, wherein the at least one metal part has a connecting section via which the clamping arm is connected to the engagement arm.

4. The contact insert according to claim 3, wherein the connecting section forms a guide surface for the electrical conductor to be clamped.

5. The contact insert according to claim 1, wherein the engagement arm has a bulge at or near a free end thereof, which is opposite the clamping arm and forms a receptacle for the bearing pin of the actuation element.

6. The contact insert according to claim 5, wherein the engagement arm extends beyond the bulge with an end section up to the free end, wherein the end section forms an insertion aid for the bearing pin during the mounting of the actuation element on the at least one metal part.

7. The contact insert according to claim 1, wherein the actuation element has a manual actuation area at which the actuation element is to be acted upon manually in order to open the clamping point, wherein two spaced apart side cheeks of the actuation element protrude from the manual actuation area, and wherein the engagement arm is arranged between the two side cheeks.

8. The contact insert according to claim 7, wherein a bearing pin of the actuation element extends from one of the two side cheeks to the other of the two side cheeks.

9. The contact insert according to claim 7, wherein the contact insert has a conductor insertion area into which the electrical conductor to be clamped is to be inserted, wherein the conductor insertion area extends through the area enclosed by the two side cheeks.

10. The contact insert according to claim 5, wherein the clamping arm has a clamping tongue on which a clamping edge for clamping the electrical conductor is arranged, wherein the clamping arm has at least one or two actuating tabs which are arranged laterally next to the clamping tongue, wherein the at least one or two actuating tabs each form contact surfaces for mechanical action by the actuation element to open the clamping point.

11. The contact insert according to claim 10, wherein the at least one or two actuating tabs simultaneously form a counter bearing with respect to a mounting of the actuation element on the engagement arm.

12. The contact insert according to claim 10, wherein the at least one or two actuating tabs are bent in the same direction as the bulge of the engagement arm.

13. The contact insert according to claim 10, wherein the actuation element has a manual actuation area at which the actuation element is to be acted upon manually in order to open the clamping point, wherein two spaced apart side cheeks of the actuation element protrude from the manual actuation area, wherein the engagement arm is arranged between the two side cheeks, wherein the actuation element has a mounting recess on one or both of the two side cheeks, wherein the actuation element in the closed position is mounted on a respective actuating tab via a respective mounting recess, and wherein a shape of the mounting recess is adapted to a shape of the respective actuating tab.

14. The contact insert according to claim 13, wherein the actuation element has an actuation contour on one or both of the two side cheeks for actuating the respective actuating tab and accordingly for deflecting the clamping arm, wherein the actuation contour comes into contact with the respective actuating tab when the actuation element is in the open position or is moved from the closed position into the open position.

15. The contact insert according to claim 1, wherein the contact insert has a busbar as a further component, which extends between the engagement arm and the clamping arm, wherein the busbar rests with a bearing side against the engagement arm and with a contact side, opposite the bearing side, together with the clamping arm forms the clamping point for the electrical conductor.

16. A conductor connection terminal comprising an insulating-material housing and at least of the one contact insert according to claim 1, which is arranged completely or partially in the insulating-material housing.

17. The conductor connection terminal according to claim 16, wherein a busbar is inserted into the contact insert through a cutout present in the insulating-material housing.

18. A contact insert for a conductor connection terminal comprising spring force clamping technology, the contact insert comprising:

a clamping spring; and a manual actuation element, wherein the clamping spring has a clamping arm which is designed to clamp an electrical conductor to a clamping point, wherein the clamping point is adapted to be opened by the manual actuation element, wherein the contact insert has at least one metal part, wherein the clamping spring is formed in one piece on the at least one metal part, wherein the at least one metal part has an engagement arm which is arranged opposite the clamping arm, so that the clamping point for the electrical conductor is arranged between the clamping arm and the engagement arm, wherein the manual actuation element is movably mounted between the clamping arm and the engagement arm, such that the actuation element is held under a pretension between the clamping arm and the engagement arm.

* * * * *